US006776412B2

(12) United States Patent
DaCunha et al.

(10) Patent No.: US 6,776,412 B2
(45) Date of Patent: Aug. 17, 2004

(54) REMOVABLE SHEET FEEDER WITH JAM CLEARANCE FOR USE IN AN ENVELOPE INSERTING MACHINE

(75) Inventors: Steven J. DaCunha, West Hartford, CT (US); Carlos L DeFigueiredo, Sandy Hook, CT (US); John J. Mercede, Jr., Easton, CT (US); Joseph R. Vassallo, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 297 days.

(21) Appl. No.: 10/004,242

(22) Filed: Oct. 25, 2001

(65) Prior Publication Data

US 2003/0080490 A1 May 1, 2003

(51) Int. Cl.[7] ..... B65H 39/041

(52) U.S. Cl. ..... 271/274; 271/162; 270/52.14

(58) Field of Search ..... 271/162, 273, 271/274, 145, 10.01, 9.01, 9.13, 9.12; 270/52.14

(56) References Cited

U.S. PATENT DOCUMENTS

| | | | | | |
|---|---|---|---|---|---|
| 3,002,746 | A | * | 10/1961 | Lloyd et al. | 270/58.29 |
| 3,809,385 | A | * | 5/1974 | Rana | 270/52.29 |
| 4,177,979 | A | * | 12/1979 | Orsinger et al. | 270/52.16 |
| 4,369,959 | A | * | 1/1983 | Hornbuckle | 271/3.03 |
| 4,501,417 | A | * | 2/1985 | Foster et al. | 271/124 |
| 4,530,200 | A | * | 7/1985 | Prewer | 53/157 |
| 4,666,140 | A | * | 5/1987 | Godlewski | 271/35 |
| 4,775,140 | A | * | 10/1988 | Foster | 271/121 |
| 5,081,825 | A | * | 1/1992 | Mrozinski | 53/569 |
| 5,164,906 | A | * | 11/1992 | Mahmoodi et al. | 700/220 |
| 5,275,395 | A | * | 1/1994 | Boggiano et al. | 271/259 |
| 5,454,554 | A | * | 10/1995 | Boughton et al. | 271/9.01 |
| 5,732,941 | A | * | 3/1998 | Moll | 271/10.07 |
| 5,772,199 | A | * | 6/1998 | Green | 271/10.06 |
| 5,888,047 | A | * | 3/1999 | Auerbach et al. | 414/797.8 |
| 5,975,519 | A | * | 11/1999 | DeFigueiredo et al. | 271/124 |

FOREIGN PATENT DOCUMENTS

| | | | | |
|---|---|---|---|---|
| GB | 2287456 | * | 9/1995 | B65H/7/00 |

* cited by examiner

*Primary Examiner*—Donald P. Walsh
*Assistant Examiner*—Daniel K Schlak
(74) *Attorney, Agent, or Firm*—Michael J. Cummings; Charles R. Malandra, Jr.; Angelo N. Chaclas

(57) ABSTRACT

A feeding module for use in an envelope inserting machine. The feeding module comprises a mounting support fixedly mounted on the chassis of the machine, and a sheet feeder releasably mounted on the mounting support, wherein the sheet feeder comprises a tray for supporting a stack of the sheets and a retrieving mechanism for retrieving one sheet at a time from the bottom of the stack. The retrieved sheet is guided through a curved channel to the moving belt of the inserting machine. The channel is formed by two curved panels, one of which can be lifted away from the other for jam clearance.

17 Claims, 12 Drawing Sheets

68
66
60
64
80
84
82

REMOVABLE SHEET FEEDER WITH JAM CLEARANCE FOR USE IN AN ENVELOPE INSERTING MACHINE

FIELD OF THE INVENTION

The present invention generally relates to a sheet feeder having means for quick mounting and removal to be used in an envelope inserting machine or the like, and, more particularly, to a sheet feeder for feeding sheets from a vertical stack.

BACKGROUND OF THE INVENTION

In an inserting machine for mass mailing, there is a gathering section where enclosure material is gathered before it is inserted into an envelope at an envelope insertion area. The gathering section is sometimes referred to as a chassis subsystem, which includes a gathering transport with pusher fingers rigidly attached to a conveyor belt and a plurality of sheet feeders mounted above the transport. If the enclosure material contains many documents, these documents must be separately fed from different sheet feeders. Inserting machines and sheet feeders are well known. For example, and U.S. Pat. No. 5,660,030 (Auerbach et al.) discloses an envelope inserter station, wherein envelopes are separately provided to an envelope supporting deck where envelopes are spread open so as to allow enclosure material to be stuffed into the envelopes. An exemplary inserting machine is shown in FIG. 1. As shown, an inserting machine 10 typically includes an envelope feeder/inserter station 12 and a plurality of sheet feeders 20. The envelope feeder/inserter station 12 includes an envelope feeder 14 above an envelope insertion area 16. Documents 22 are separately released from the sheet feeders 20 onto a long deck 30 and collated as the released documents 22' are pushed by a plurality of pusher fingers 32 driven by one or more endless belts or chains 34 toward the envelope feeder/inserter station 12. At the same time, a stack of envelopes 18 are placed on the envelope feeder 14 so that one envelope at a time is released from the envelope feeder 14 into the envelope insertion area 16 where the envelope is spread open to allow the collated documents to be stuffed into the envelope. Typically the sheet feeders are fixedly mounted to inserting machine 10 above the deck 30. As shown, the enclosure feeder 20 has a slant tray 24 for supporting the documents 22 to be released. This type of slant tray design has a very limited capacity for stacking the documents 22, partly due to the fixed distance between adjacent enclosure feeders 20. Slant trays are widely used in envelope inserting machines, as can be seen in U.S. Pat. No. 4,501,417 (Foster et al.), U.S. Pat. No. 4,753,429 (Irvine et al.) and U.S. Pat. No. 5,660,030 (Auerbach et al.). U.S. Pat. No. 5,120,043 (Mazullo) also discloses an enclosure feeder with a slant tray for supporting the documents. U.S. Pat. No. 4,817,368 (DePasquale et al.) discloses a mailing inserting and collating apparatus, wherein a plurality of envelope hoppers each contains a vertical stack of mailing inserts for releasing the inserts into a plurality of opened envelopes. Under each envelope hopper, a rubber kicker roller having an arcuate outer surface, along with a vacuum port, is used to retrieve the bottommost insert from the stack. The major advantages of the vertical stack include that it can support more inserts or documents to be released and that the replenishing of documents is easy. As mentioned earlier, U.S. Pat. No. 4,177,979 (Orsinger et al.) discloses an inserting machine having a plurality of vertical stack feeders for feeding enclosure material, wherein the feeders can be moved to various positions along the chassis and fixed in place at those positions. As disclosed in U.S. Pat. No. 4,177,979, the chassis frame has a plurality of apertures for the feeders to be bolted to the chassis frame. Thus, it is possible to change the position of the feeders by removing bolts, moving the feeders to new positions and fastening the bolts through different apertures. Because, each of the feeders 20 has rollers 36 to release the enclosure materials at the appropriate time, it is necessary to link the rollers 36 to a driving mechanism by pulleys 38 and timing belts 40, as shown in FIG. 2.

In prior art inserting machines, the close proximity of the feeders and the released documents makes it difficult to access the paper path to clear document jams. U.S. Pat. No. 5,454,554 (Boughton et al.) discloses a feeder assembly having a slant tray, which can be pivotally mounted to an inserter machine frame to provide easy access to the paper path underlying a feeder downstream from the releasing feeder for clearing paper jams. When the documents are fed from a vertical stack, jam clearance becomes more difficult.

Thus, it is advantageous and desirable to provide a vertical stack sheet feeder that can be easily removable from the chassis and has access to jams.

SUMMARY OF THE INVENTION

According to the first aspect of the present invention, a feeding module for feeding sheet material items one at a time from a stack onto a conveying mechanism whereby the fed items are moved from upstream to downstream in a moving direction along a chassis, said feeding module comprising:

- a mounting support fixedly mounted on the chassis; and
- a sheet feeder releasably mounted on the mounting support, wherein the sheet feeder comprises:
  - a frame;
  - a tray, mounted on the frame, for supporting the stack of the sheet material items;
  - means, located adjacent to the bottom of the stack, for retrieving the items;
  - a feeding channel, located adjacent to the retrieving means, for channeling the retrieved items to the conveying mechanism, wherein the feeding channel comprises a first channel guide and a second channel guide spaced apart to define a release path for guiding the retrieved items through the release path to the conveying mechanism, and wherein the first channel guide is removably mounted on the frame so as to allow the first channel guide to be separated from the second channel guide for jam clearance and maintenance of the sheet feeder; and
  - means, attached to the frame, for securing the sheet feeder to the mounting support.

Preferably, the securing means comprises a mounting rod fixedly attached to the frame, and wherein the mounting support comprises two mounting members spaced from each other along the moving direction, each mounting member having a groove to receive the rod for mounting the sheet feeder to the mounting support.

Preferably, the securing means further comprises a latch operable in a first position for preventing the rod from being separated from the grooves and in a second position allowing the rod to be separated from the grooves.

Preferably, the feeding channel comprises a plurality of rollers disposed on the first channel guide for guiding the released items through the release path.

Preferably, the sheet feeder has a front side facing the downstream end and a rear side facing the upstream end, and the feeding channel is located on the rear side of the sheet feeder such that the released items enter the release path along a direction substantially opposite to the moving direction. According to the present invention, the first and second channels are curved from the rear side toward the front side of the sheet feeder such that the released items emerge from the release path along a direction substantially the same as the moving direction.

Preferably, the sheet feeder further comprises a driving mechanism operatively connected to the retrieving means for retrieving the sheet material items, and the driving mechanism is electrically connected to a power source in the chassis.

Preferably, the first channel guide comprises a connection means for rotatably attaching the first channel guide to the frame so as to allow the first channel guide to be moved away from the second channel guide at one end of the feeding channel.

According to the second aspect of the present invention, a feeding module for feeding sheet material items one at a time from a stack onto a conveying mechanism whereby the fed items are moved from upstream to downstream in a moving direction along a chassis, said feeding module comprising:

a mounting support fixedly mounted on the chassis; and a sheet feeder releasably mounted on the mounting support, wherein the sheet feeder comprises:

a frame;

a tray, mounted on the frame, for supporting the stack of the sheet material items;

means, located adjacent to the bottom of the stack, for retrieving the items;

a feeding channel, located adjacent to the retrieving means, for channeling the retrieved items to the conveying mechanism, wherein the feeding channel comprises a first channel guide and a second channel guide spaced apart to define a releasing path for guiding the retrieved items through the releasing path to the conveying mechanism, and wherein the first channel guide is removably mounted on the frame so as to allow the first channel guide to be separated from the second channel guide for jam clearance and maintenance of the sheet feeder; and means, attached to the frame, for securing the sheet feeder to one of the mounting supports.

The present invention will become apparent upon reading the description taking in conjunction with FIGS. 3 to 10.

DETAILED DESCRIPTION

Figure 1:
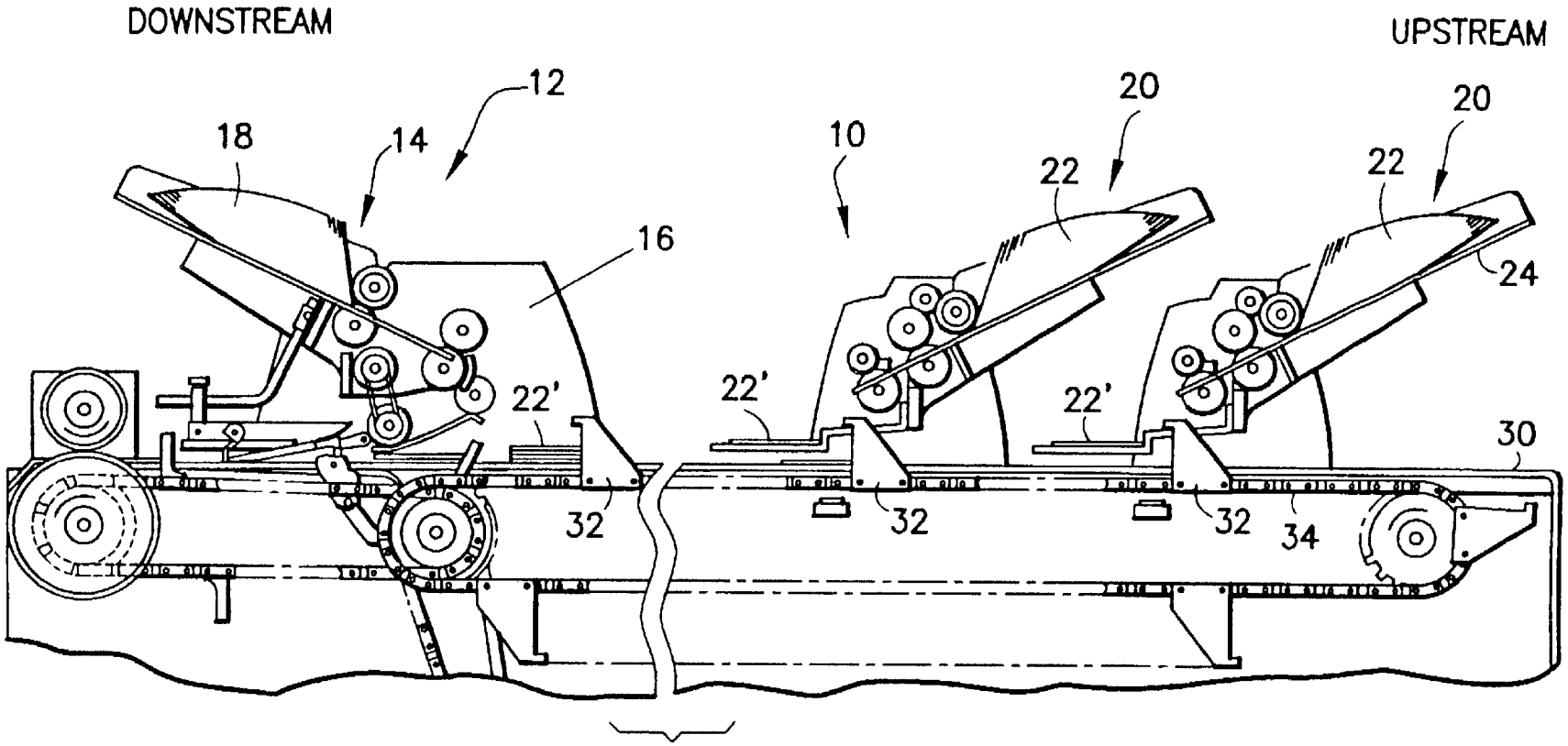
FIG.1 PRIOR ART
FIG. 1 is a diagrammatic representation showing a prior art envelope inserting machine for mass mailing.
Figure 2:
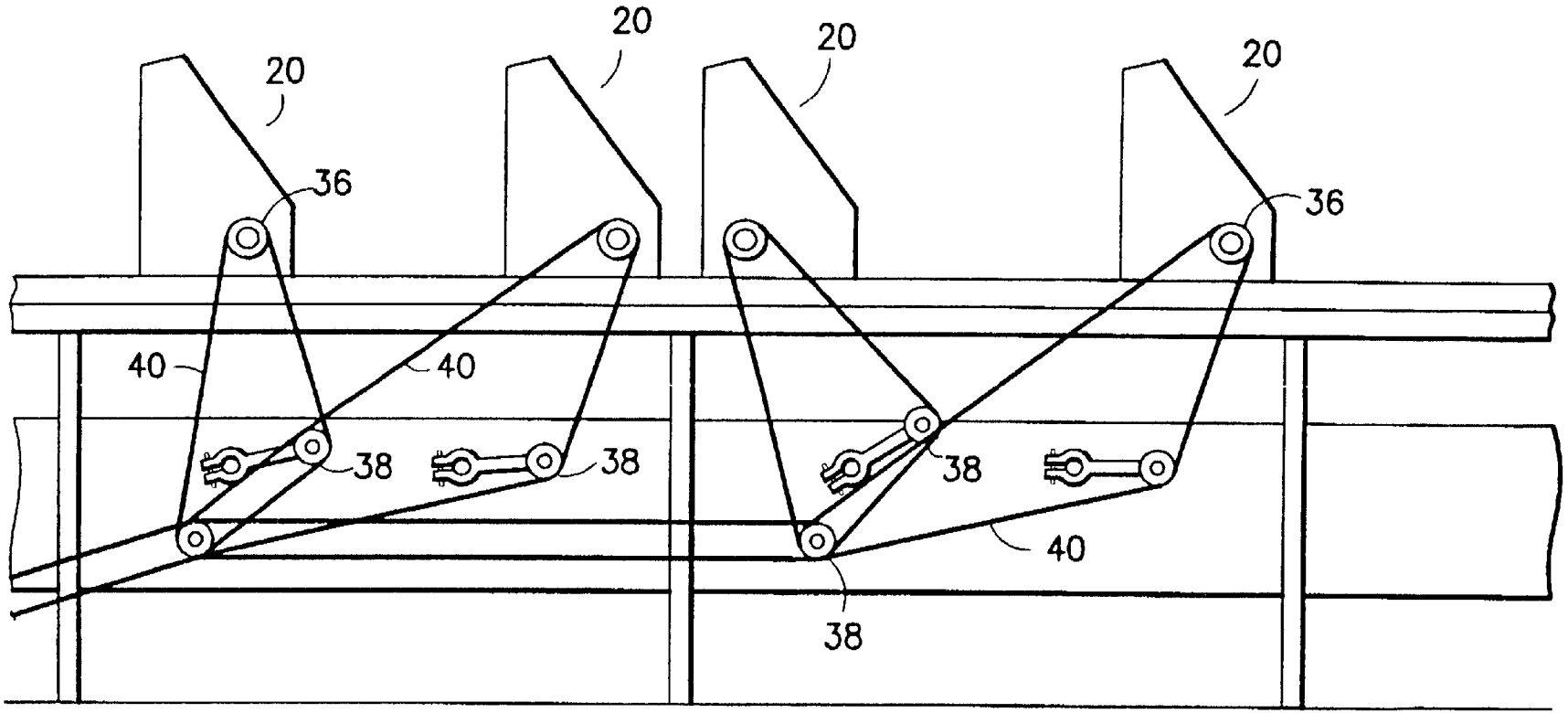
FIG.2 PRIOR ART
FIG. 2 is a diagrammatic representation showing a plurality of vertical stack feeders on a prior art envelope inserting machine.
Figure 3:
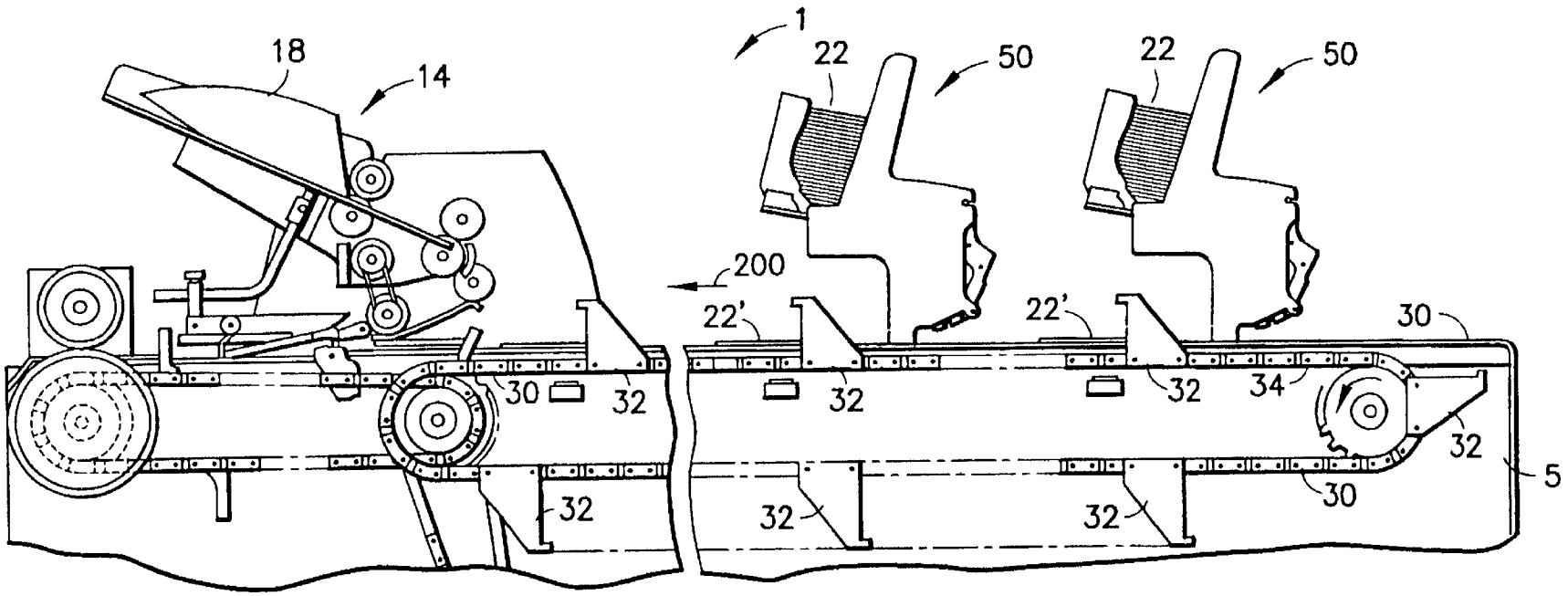
FIG. 3 is a side view showing the envelope inserting machine having a plurality of feeding modules, according to the present invention.
Figure 4:
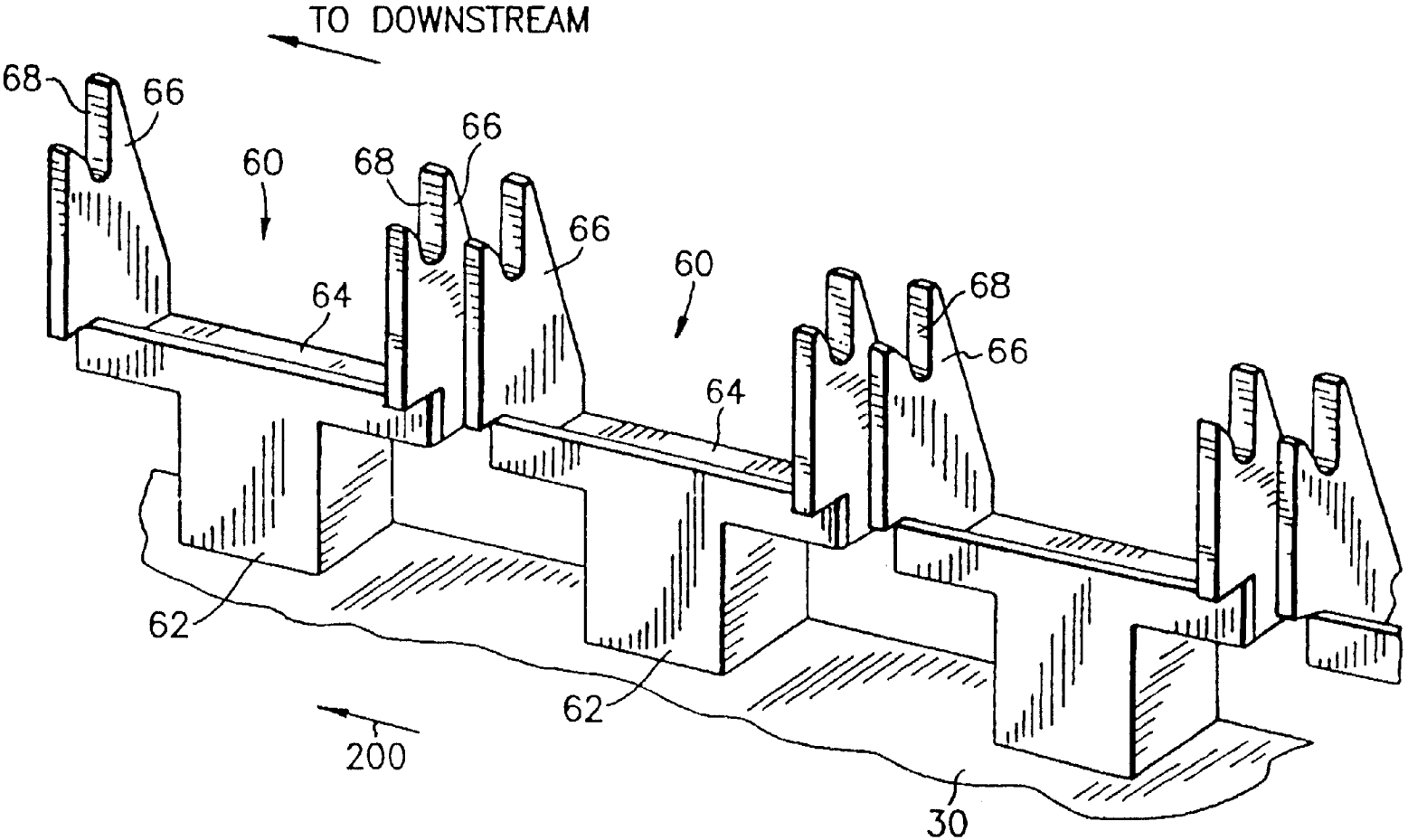
FIG. 4 is a perspective view showing the mounting supports on an envelope inserting machine for removably mounting the sheet feeders, according to the present invention.

FIG. 3 is a side view of the envelope inserting machine 1, according to the present invention. As shown, the envelope inserting machine 1 has a chassis 5 and a plurality of feeding modules 50 for separately releasing documents 22 onto a long deck 30 on top of the chassis 5. A plurality of pusher fingers 32, driven by one or more endless belts 34 for pushing the released documents 22' from the upstream end to the downstream end in a direction indicated by arrow 200. The sheet material, in the form of documents 22, fed from feeding modules 50 may be flat or folded sheets. The upper part of the endless belts 34 is a moving surface moving along the moving direction 200 while the lower part moves in an opposite direction. At the downstream end, the released documents are collated into a stack, to be inserted into an envelope 18 released from the envelope feeder 14. Envelope feeders are known in the art and not part of the present invention. As can be seen in FIGS. 4–9*b*, the feeding module 50 of the present invention includes a sheet feeder 52 and a mounting support 60. Advantageously, while the mounting supports 60 are fixedly mounted on the deck 30 of the envelope inserting machine 1, the sheet feeders 52 are releasably mounted on the mounting supports 60, so that the sheet feeders 50 can be easily removed from the envelope inserting machine 1 for maintenance purposes. As such, the removed sheet feeder 52 can be replaced by another one to reduce the downtime of the machine. The mounting supports 60 are shown in FIG. 4. As shown, each mounting support 60 has a base support 62, which is fixedly mounted on the deck 30 of the envelope inserting machine 1. The mounting support 60 further includes two mounting feet 66 separated along the moving direction 200 by a base plate 64. Each mounting foot 66 has a mounting groove 68. The mounting of the sheet feeders 52 on the mounting supports 60 will be described in conjunction with FIGS. 7 to 9*b*.

Figure 5:
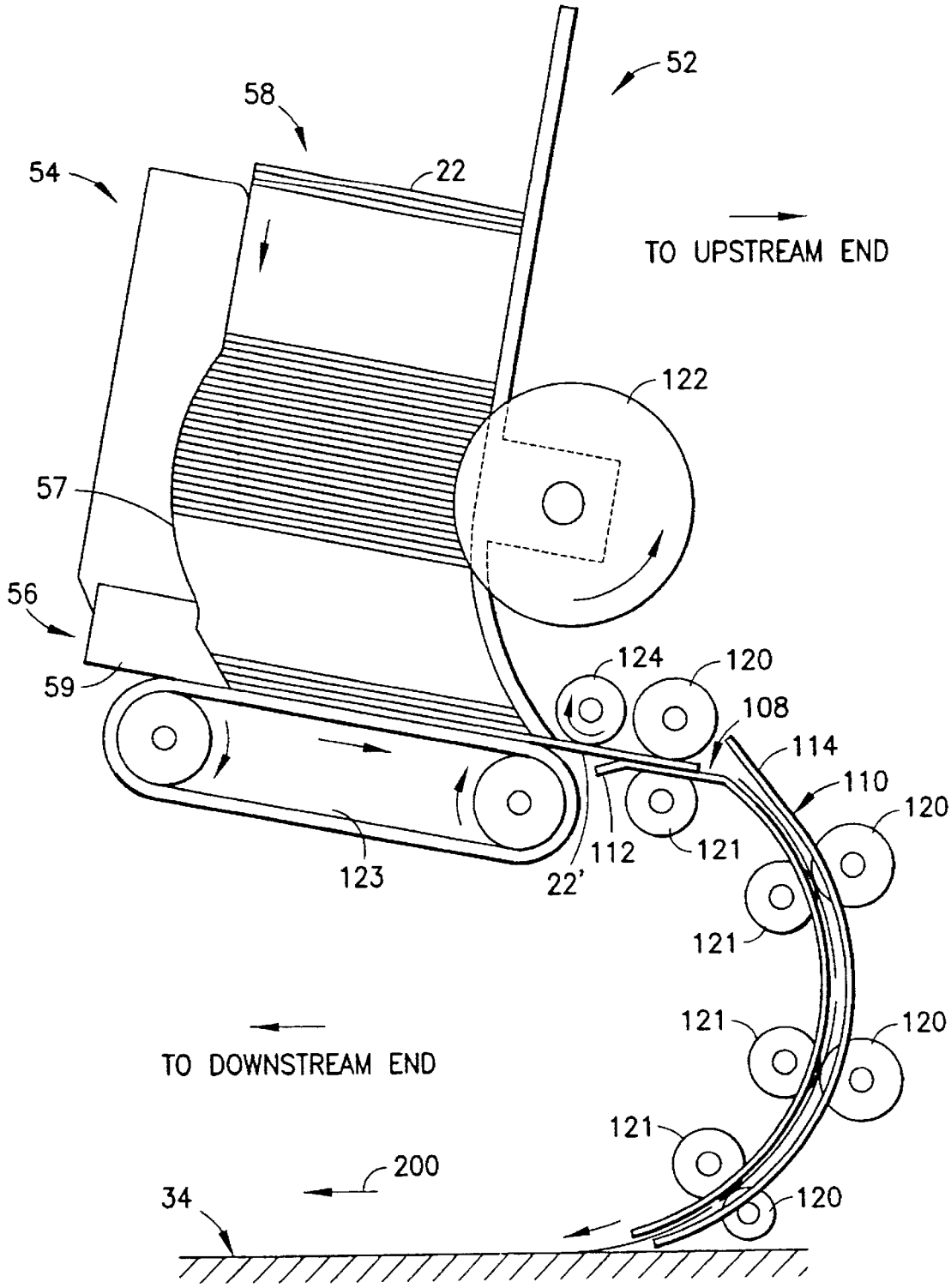
FIG. 5 is diagrammatic representation showing the linkage between the document stack and the feeding channel.

Referring to FIG. 5, sheet feeder 52 is tilted with an upper portion of the sheet feeder 52 leaning in an upstream direction. This tilted configuration, in conjunction with a stack guiding arrangement of the sheet stack receptacle 58 provides for greater reliability and jam prevention in sheet feeding. The stack guiding arrangement includes concave surface 57 on the opposite side of the sheet stack receptacle 58 from a counteracting roller 122. Counteracting roller 122, the concave surface 57 and the tilt of sheet feeder 52, serve to support the stack of documents 22 in a manner that improves reliability and jam prevention in a manner as described in co-pending U.S. patent application Ser. No. 09/824,326, filed on Apr. 3, 2001 and issued as U.S. Pat. No. 6,585,257, entitled SHEET FEEDER WITH COUNTERACTING FORCES, which is hereby incorporated by reference in its entirety. Counteracting roller 122 is typically an idler roller that rotates as the stack of documents 22 moves in a downward direction.

At the bottom of sheet stack receptacle 58, a retrieving belt 123 removes individual documents 22' from the bottom of the stack and directs them towards feeding channel 110. In order to ensure that individual documents 22' are properly separated, a separator mechanism 124 is positioned at the downstream end of retrieving belt 123. Separator mechanism 124 may be a stationary object forming a narrow gap through which only a single document 22' may pass, or it may be a roller that rotates opposite the direction of retrieving belt 123, as depicted in FIG. 5.

Sheet stack receptacle 58 may also advantageously include a guide ramp 59 to assist in supporting the stack of documents 22. It has been determined that such a guide ramp 59 contributes to better performance and fewer jams of the sheet feeder 52. Guide ramp 59 preferably forms a 45 degree angle with the top surface of retrieving belt 123 as depicted. As a result of the guide ramp 59, much of the weight of the stack of documents 22 is isolated from the feed belt 123, thereby contributing to improved reliability.

In addition to the advantages of easy removal and reliable feeding, the sheet feeder 52 has another major advantage in that it easily allows for the clearance of paper jams. Unlike most sheet feeders, the sheet feeder 52, according to the present invention, retrieves a document 22 from a tray region 56 at the bottom of sheet stack receptacle 58 (see FIG. 5) in a direction substantially opposite to the moving direction 200 of the released documents 22'. The document 22' retrieved from the bottom of the stack on the tray 56 is moved towards feeding channel 110 by retrieving belt 123 and separated by separator mechanism 124. Channel rollers 120 and driven channel rollers 121 receive the retrieved document 22' and transport it through feeding channel 110.

Figure 6A:
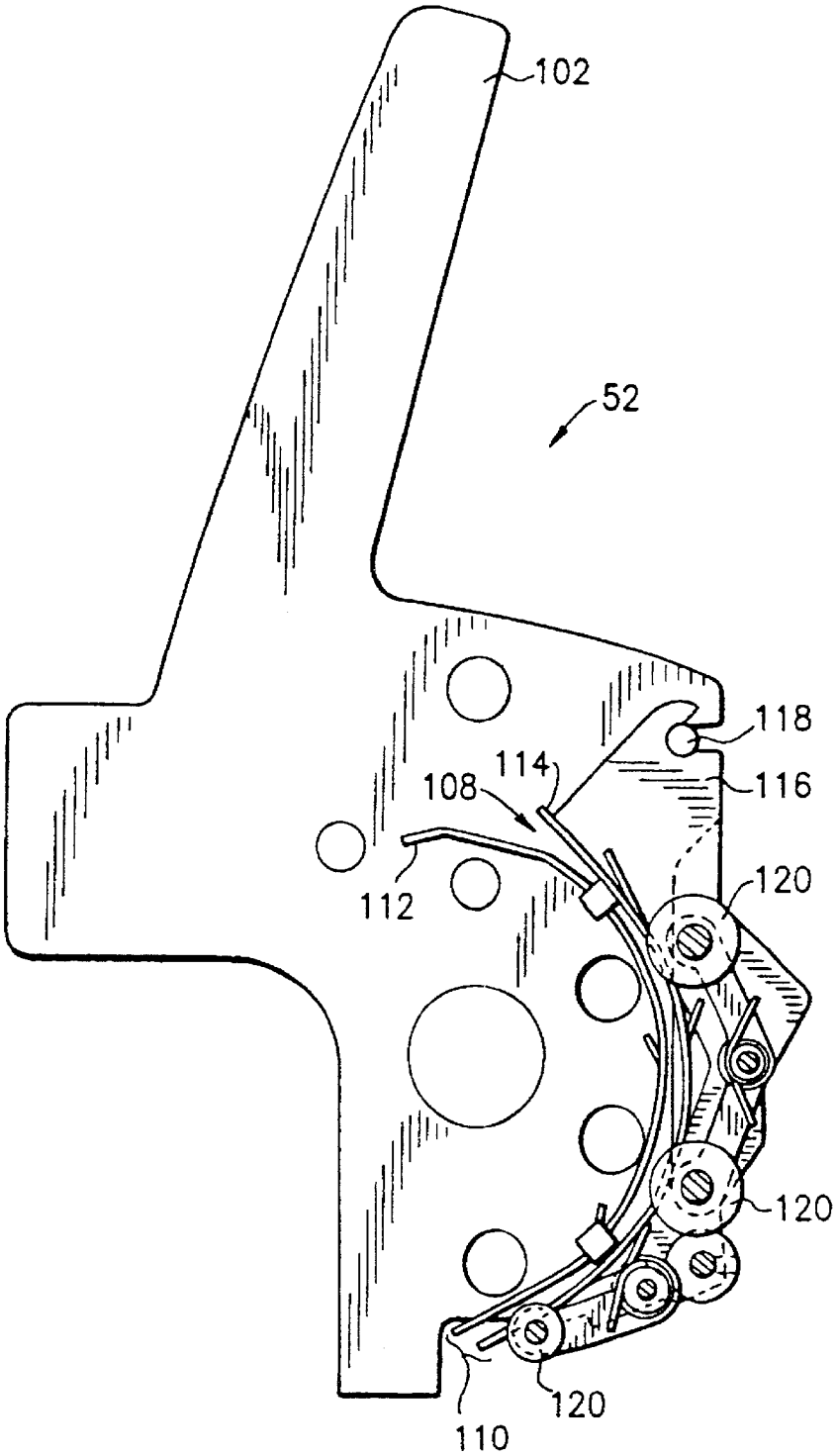
FIG. 6*a* is a side view of the sheet feeder showing a feeding channel.
Figure 6B:
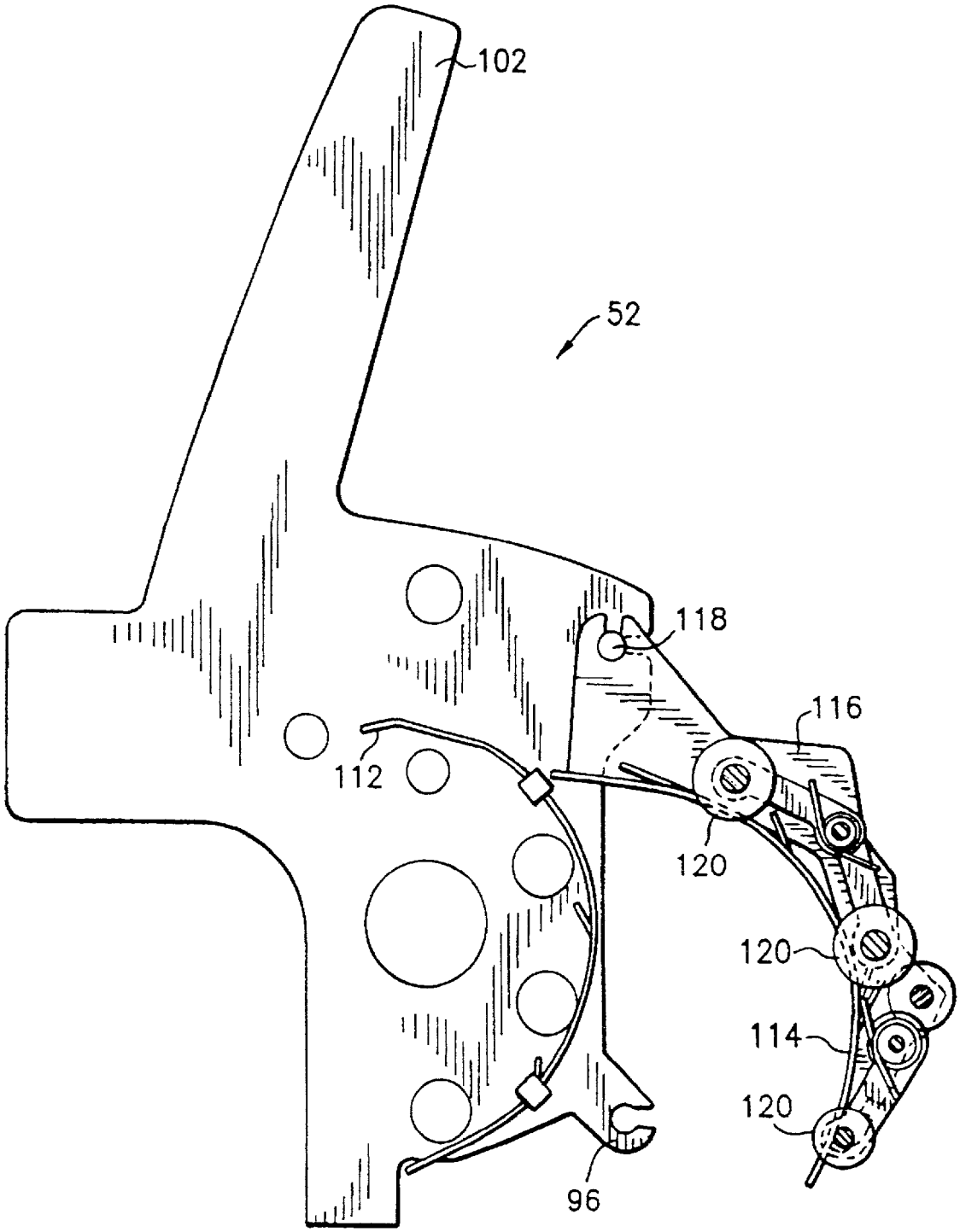
FIG. 6*b* is a side view of the sheet feeder showing the feeding channel in an open position.
Figure 7:
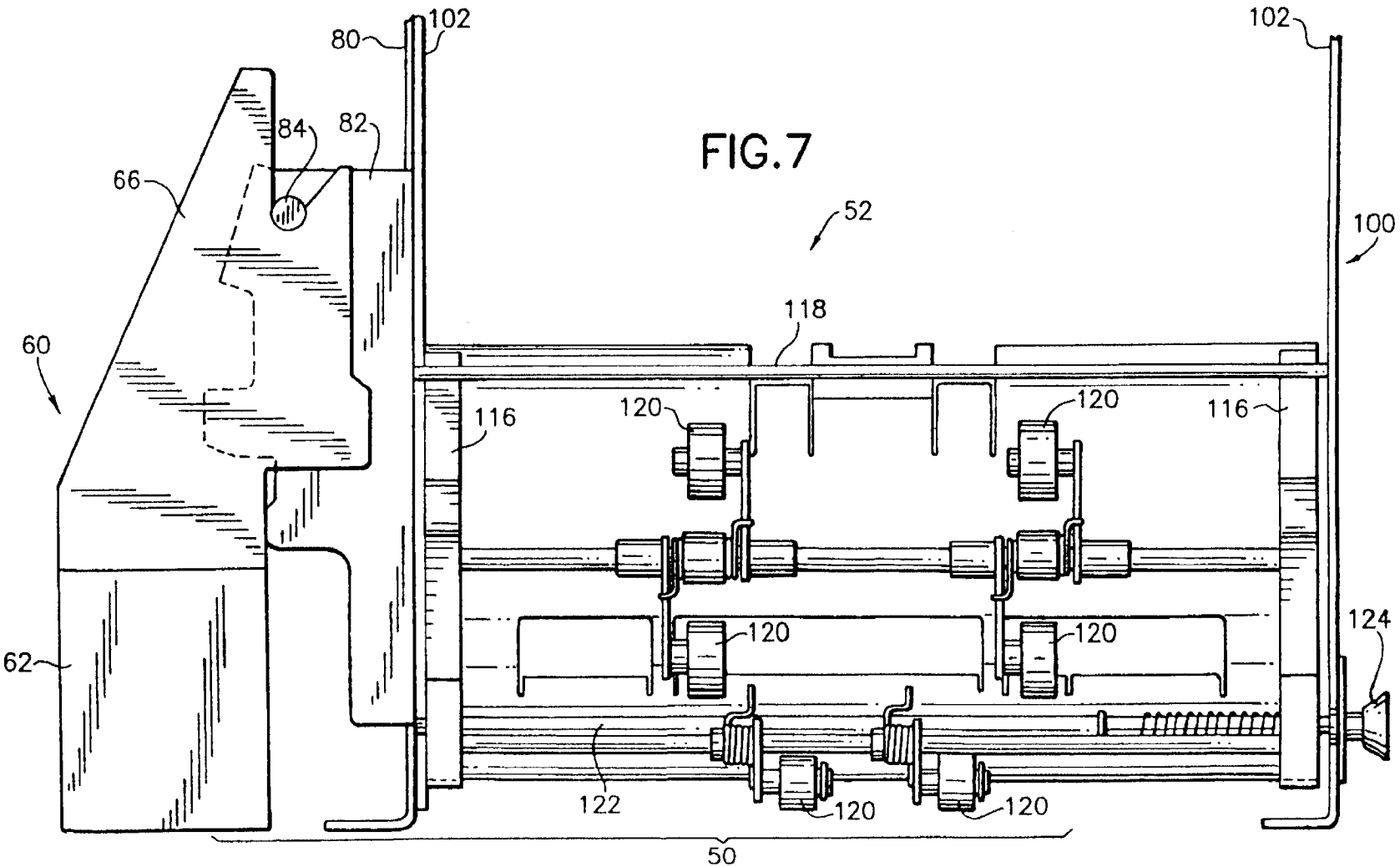
FIG. 7 is rear view of the feeding module showing a mounting support and part of the sheet feeder including a mounting bracket for mounting the sheet feeder to the mounting support.

When it emerges from the channel 110, the released document 22' will be pushed along the direction 200 by a pusher finger 32 (FIG. 3) toward the downstream end. As shown in FIGS. 6A, 6B and 7, the feeding channel 110 is mounted between two side plates 102 of a frame 100. As shown in FIGS. 6*a* and 6*b*, the feeding channel 110 comprises an inner guide 112 and an outer guide 114. The outer guide 114 and the rollers 120 are mounted between two guide mounts 116 as shown in FIG. 7. The guide mounts 116 are pivotally mounted to the side plates 102 with a rod 118. At normal operation, the guide mounts 116 are securely latched to a latch 96 on the side plates 102 with a rod 126 and locked in place by a knob 124 (FIG. 7). As such, the inner guide 112 and the outer guide 114 define a release path 108 (FIG. 6A) for guiding a released item to the upper surface of the endless belts 34 (FIG. 3). In case of a paper jam, the outer guide 114 can be lifted upward, away from the inner plate 112, as shown in FIG. 6*b*.

Figure 8:
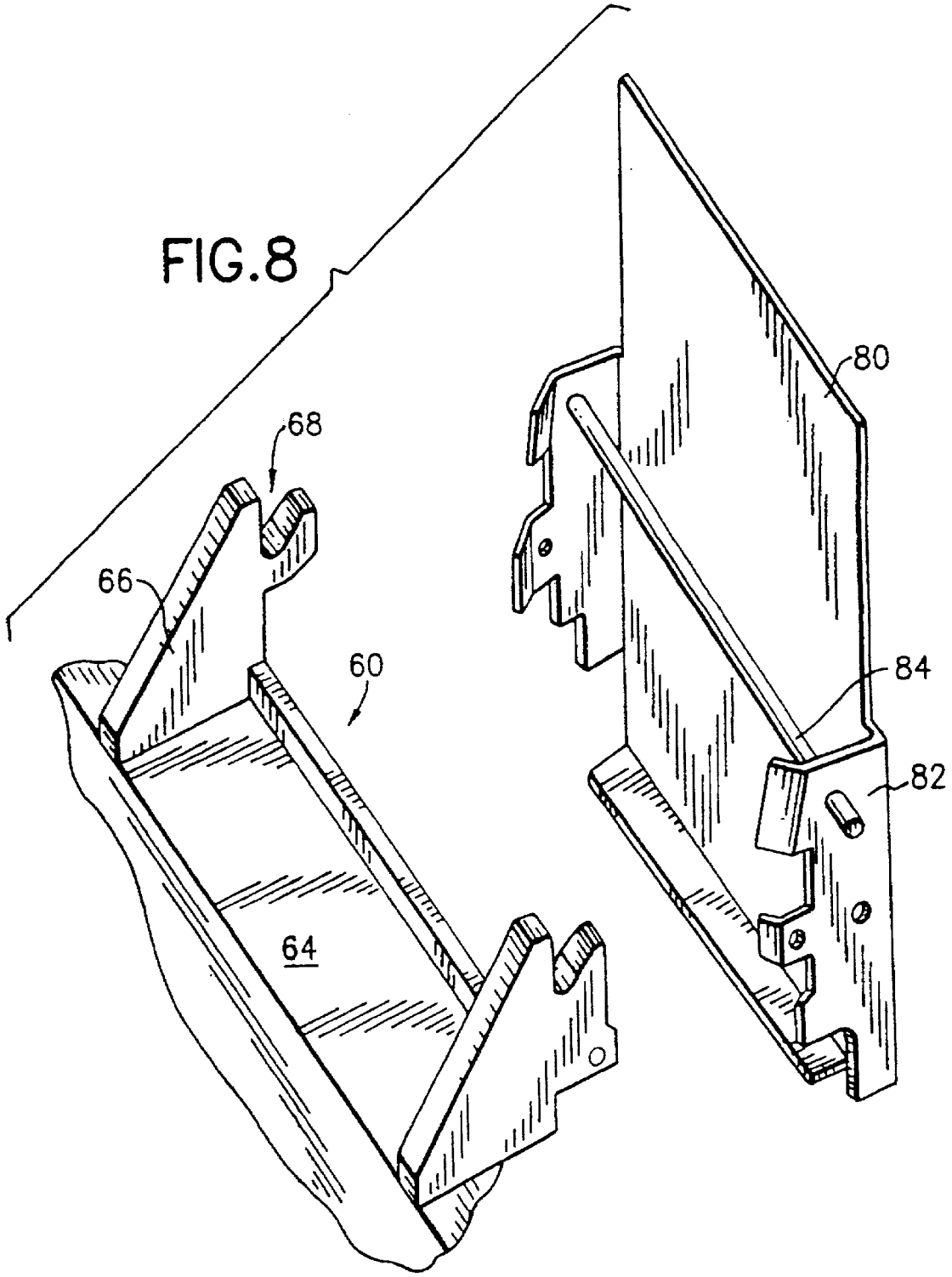
FIG. 8 is an isometric view showing the mounting bracket and the mounting support.
Figure 9A:
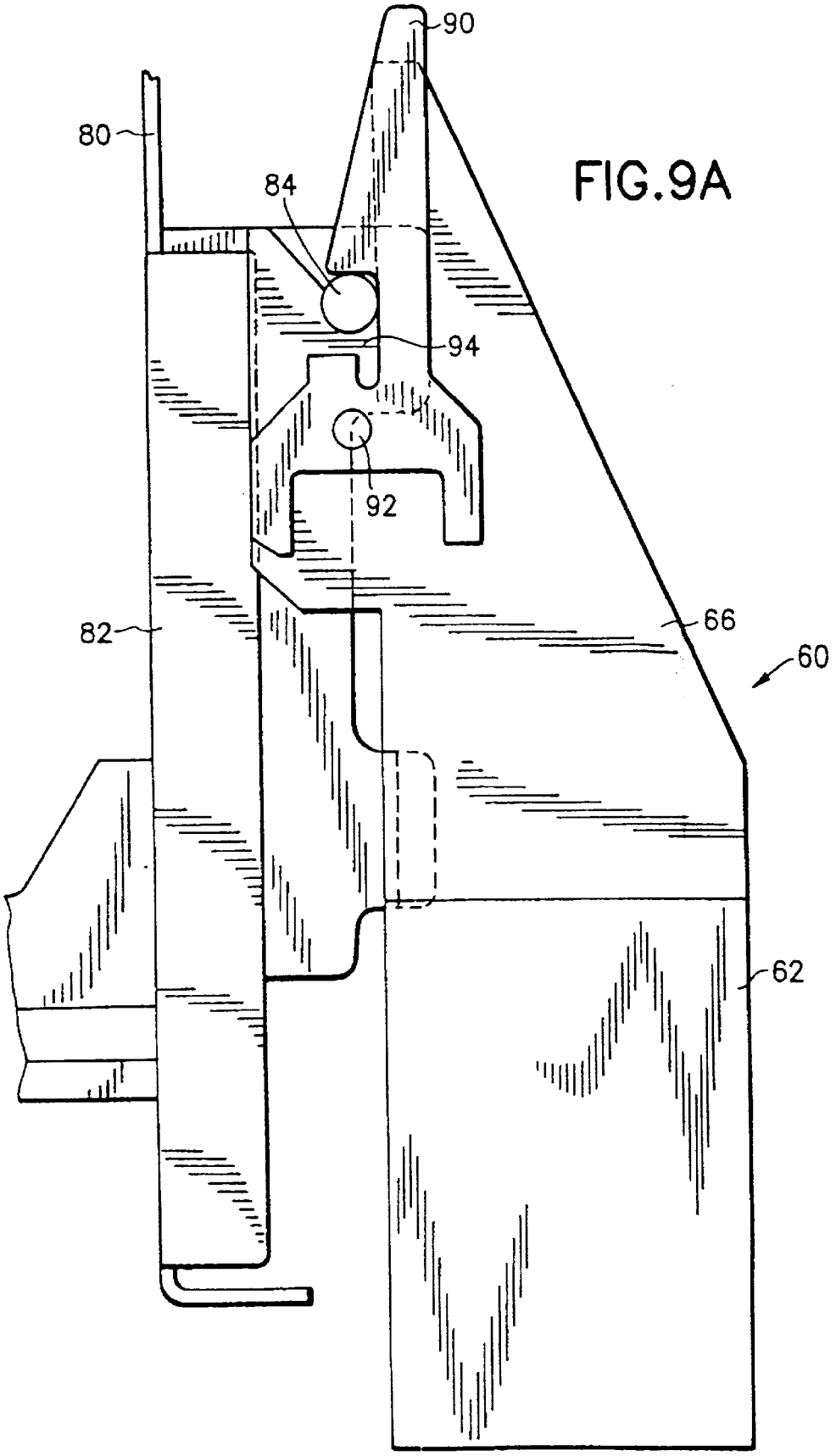
FIG. 9*a* is an isometric view showing a latch for securing the sheet feeder onto the mounting support.
Figure 9B:
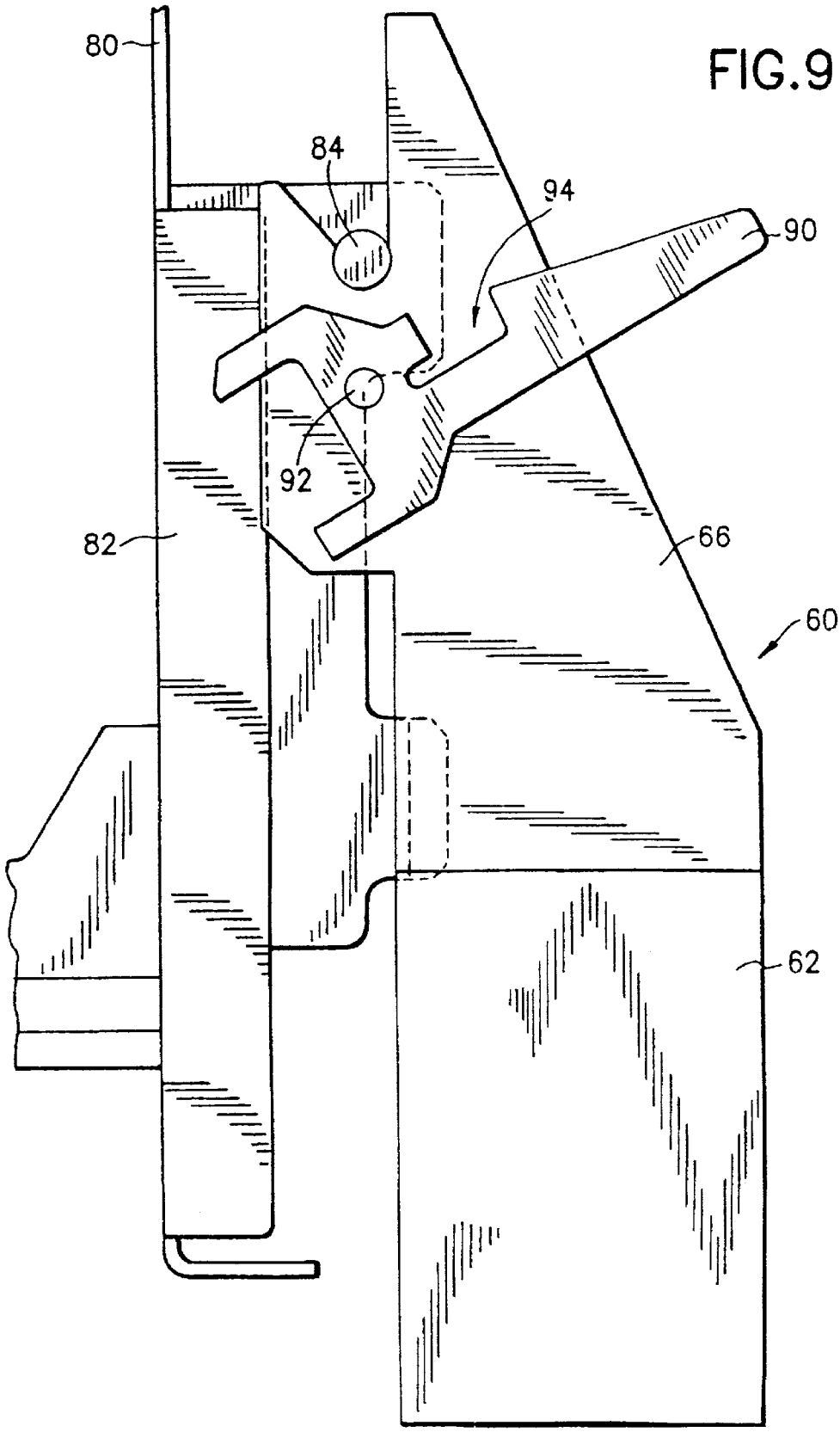
FIG. 9*b* is an isometric view showing the latch in an "off" position.

As shown in FIG. 7, one of the side plates 102 is secured to a mounting plate 80 and a mounting bracket 82 for removably mounting the sheet feeder 52 onto a mounting support 60. The mounting bracket 82 and the mounting support 60 are shown in FIG. 8. As shown, the groove 68 of the upper section of each mounting foot 66 is used for receiving a mounting rod 84 on the mounting bracket 82. As such, the sheet feeder 52 can be lifted upward to disengage the mounting rod 84 from the groove 68 when the sheet feeder 52 is removed from the envelope inserting machine 1. In order to secure the sheet feeder 50 to the mounting support 60, it is preferred that a latch 90, disposed either on the mounting foot 66 or the mounting bracket 82, is used to prevent the mounting rod 84 from being moved away from with the grooves 68. As shown in FIGS. 9*a* and 9*b*, the latch 90 is pivotally mounted on one of the mounting feet 66 at pivot 92. The latch 90 has a hook 94 to lock the mounting rod 84 securely in place, as shown in FIG. 9*a*. The latch 90 can be rotated to disengage the hook 94 from the mounting rod 84, as shown in FIG. 9*b*, to allow the sheet feeder 52 to be removed from the mounting support 60.

As shown in FIG. 5, the retrieving belt 123 and driven rollers 121 rotate in order to retrieve a document 22' from the tray 56 and to transport the document 22' through feed channel 110. Thus, it is necessary to link the retrieving belt 123 and rollers 121 to one or more driving mechanisms, such as a motor, via belts and pulleys, or servo mechanisms. In order to facilitate the removal of the sheet feeder 52 from the envelope inserting machine 1, it is preferred that at least each sheet feeder 52 be equipped with its own driving mechanism.

Figure 10:
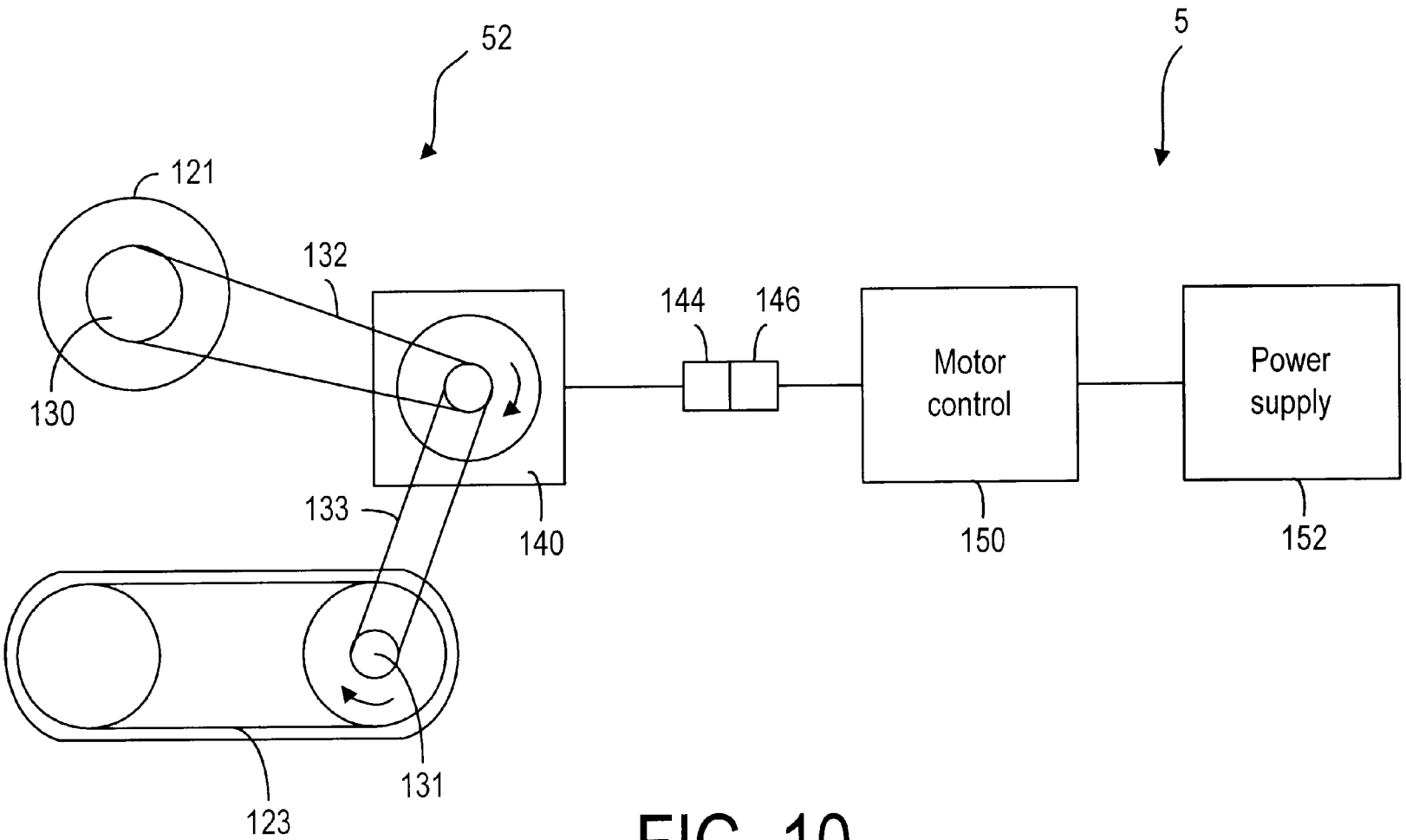
FIG. 10 is a diagrammatic representation showing a power source in the chassis being connected to a driving mechanism in the sheet feeder.

As shown in FIG. 10, each sheet feeder 52 has a driving mechanism, such as a motor 140, to drive rollers 121 and the retrieving belt 123 via pulleys 130, 131 and belts 132, 133. Through connectors 144 and 146, the motor 140 is controlled by a motor control 150 and a power supply 152 in the chassis 5. The motor controller 150 controls the retrieving sequence of the sheet feeder 52 in each feeding module in synchronism with other feeding modules and the pushing fingers 32. The electrical connectors 144 and 146 can easily be disconnected from each other in order to physically and electrically disconnect the sheet feeder 52 from the chassis 5.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A feeding module for feeding sheet material items one at a time from a stack onto a conveying mechanism whereby the fed items are moved from upstream to downstream in a moving direction along a chassis, said feeding module comprising:

a mounting support fixedly mounted on the chassis; and a sheet feeder releasably mounted on the mounting support, wherein the sheet feeder comprises:

a frame;

a tray, mounted on the frame, for supporting the stack of the sheet material items;

means, located adjacent to the bottom of the stack, for retrieving the items;

a feeding channel, located adjacent to the retrieving means, for channeling the retrieved items to the conveying mechanism, wherein the feeding channel comprises a first channel guide and a second channel guide spaced apart to define a releasing path for guiding the retrieved items through the releasing path to the conveying mechanism, and wherein the first channel guide is removably mounted on the frame so as to allow the first channel guide to be separated from the second channel guide for jam clearance and maintenance of the sheet feeder;

means, attached to the frame, for securing the sheet feeder to the mounting support; and wherein the securing means comprises a mounting rod fixedly attached to the frame, and wherein the mounting support comprises two mounting members spaced from each other along the moving direction, each mounting member having a groove to receive the rod for mounting the sheet feeder to the mounting support.

2. The feeding module of claim 1, wherein the securing means further comprises a latch operable in a first position for preventing the rod from being separated from the grooves and in a second position allowing the rod to be separated from the grooves.

3. The feeding module of claim 1, wherein the retrieving means comprises at least one roller.

4. The feeding module of claim 3, wherein the sheet feeder further comprises a driving mechanism for driving said at least one roller.

5. The feeding module of claim 4, wherein the driving mechanism comprises a motor electrically connected to a power source in the chassis for driving said at least one roller via at least one pulley and one driving belt.

6. The feeding module of claim 5, wherein the motor is electrically connected to the power source via a connector which can be disconnected so as to physically disconnect the motor from the power source.

7. The feeding module of claim 1, wherein the sheet feeder further comprises a driving mechanism for driving the retrieving means when the retrieving means retrieves the items.

8. The feeding module of claim 7, wherein the driving mechanism is electrically connected to a power source in the chassis through a connector which can be disconnected to physically disconnect the moving mechanism and the power source.

9. The feeding module of claim 8, wherein the driving mechanism is electrically connected to the power source via a control module for controlling the retrieving of the items by the retrieving means.

10. The feeding module of claim 1, further comprising a plurality of rollers disposed along the feeding channel for guiding the retrieved items through the releasing path.

11. An envelope inserting machine including a chassis having an upstream and a downstream end, an envelope feeder in a downstream end for releasing envelopes, and a conveying mechanism having a moving surface extending over at least one part of the chassis and moving from the upstream end to the downstream end in a moving direction, said envelope inserting machine comprising:

a plurality of mounting supports fixedly mounted on the chassis along the moving direction; and a plurality of sheet feeders releasably mounted on the mounting supports for releasing sheet material items onto the moving surface of the conveying mechanism; wherein the sheet feeders comprise:

a frame;

a tray, mounted on the frame, for supporting the stack of the sheet material items;

means, located adjacent to the bottom of the stack, for retrieving the items;

a feeding channel, located adjacent to the retrieving means, for channeling the retrieved items to the conveying mechanism, wherein the feeding channel comprises a first channel guide and a second channel guide spaced apart to define a releasing path for guiding the retrieved items through the releasing path, and wherein the first channel guide is removably mounted on the frame so as to allow the first channel guide to be separated from the second channel guide for jam clearance and maintenance of the feeding module; and means, attached to the frame, for securing the feeding module to one of the mounting supports.

12. The envelope inserting machine of claim 11, wherein each of the sheet feeders further comprises a driving mechanism operatively connected to the retrieving means for driving the retrieving means when retrieving the items.

13. The envelope inserting machine of claim 12, further comprising a power source disposed on the chassis for providing the driving mechanism in the sheet feeders.

14. The envelope inserting machine of claim 13, wherein the power source is electrically connected to the driving mechanism in each sheet feeder via a connector which can be disconnected for physically and electrically disconnecting the power source and the driving mechanism if so desired.

15. The envelope inserting machine of claim 14, wherein the retrieving means comprises at least one roller and the driving mechanism comprises a motor operatively connected to said at least one roller via at least one pulley and one belt for driving said at least one roller.

16. The envelope inserting machine of claim 13, wherein the power source is electrically connected to the driving mechanism via a controller for control a retrieving sequence in each sheet feeder.

17. The envelope inserting machine of claim 11, wherein the retrieving means comprises at least one roller.

* * * * *